United States Patent [19]

Knight

[11] 4,166,372

[45] Sep. 4, 1979

[54] MULTI-STATION TRANSFER PRESS HAVING PUNCH EXTENDING MEANS

[75] Inventor: David W. Knight, Stratford, Conn.

[73] Assignee: The U.S. Baird Corporation, Stratford, Conn.

[21] Appl. No.: 905,373

[22] Filed: May 12, 1978

[51] Int. Cl.[2] ..... B21D 22/00

[52] U.S. Cl. ..... 72/348; 72/335; 72/405; 72/422

[58] Field of Search ..... 72/335, 336, 348, 356, 72/404, 405, 421, 422

[56] References Cited

U.S. PATENT DOCUMENTS

| | | | |
|---|---|---|---|
| 1,987,101 | 1/1935 | Fabrice | 72/348 X |
| 2,049,915 | 8/1936 | Lewis | 72/419 X |
| 2,150,890 | 3/1939 | Franglia | 72/348 X |
| 2,411,082 | 11/1946 | Conti | 72/348 X |

*Primary Examiner*—Leon Gilden

*Attorney, Agent, or Firm*—Wooster, Davis & Cifelli

[57] ABSTRACT

A multi station metal forming press comprising: a single reciprocating ram; a plurality of tools carried by said ram in fixed positions relative thereto and individually being disposed at the stations, said tools being mounted for simultaneous movement with said ram jointly the same linear distance, whereby the maximum amount of linear movement of said ram and said tools is limited by the inherent configuration of said press thereby limiting the length of work piece drawing capacity of said tools; a transfer means for carrying work piece sequentially in a predetermined manner to each station; and an additional pair of tools at two of the stations; and means mounting said additional pair of tools on said ram for simultaneous movement therewith but a linear distance greater than the linear distance said ram moves, whereby said additional pair of tools have a work piece drawing capacity greater than that of said tools.

19 Claims, 13 Drawing Figures

RF
R
14
32
22
10
PEM
50
56
20
40
54
70
21
22B
22
22A
80
16
60
12
92
94
PBK
PCA
90
49
D7
DH
47
43
PC
48
T7
D0
D6
T6
PH
D5
ET5
D0
ET4
DHS
PCS
T3
OH
DH
DAB
PB
T2
D4
OK
DCB
DCK
DK
DAS
OB
DB
96
99
97
102
98
B
TS 10
20T
80
40
22
50
60
20
92
56
RF
R
12
40
20T
70
72
21
22B
22
22A
94
50
8
60
12
80
20
10
45
41
40
90
42
44
47
PB
43
48
46
TR
TF4
DA
TF4
TR
DHS
DO
P4
DH
DC
DCK
90
DK
KP4
DB
122
99
T
114
114
DCB
96
112
97
98
102
100
B
120
118
116
110
126
124

Fig. 7.
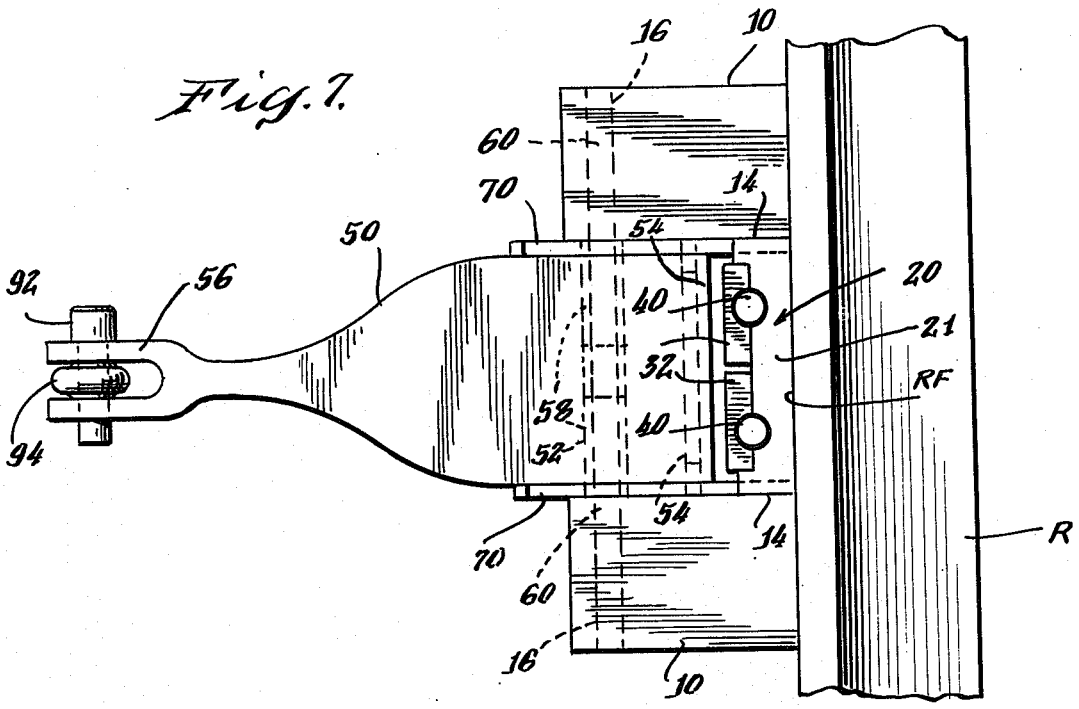
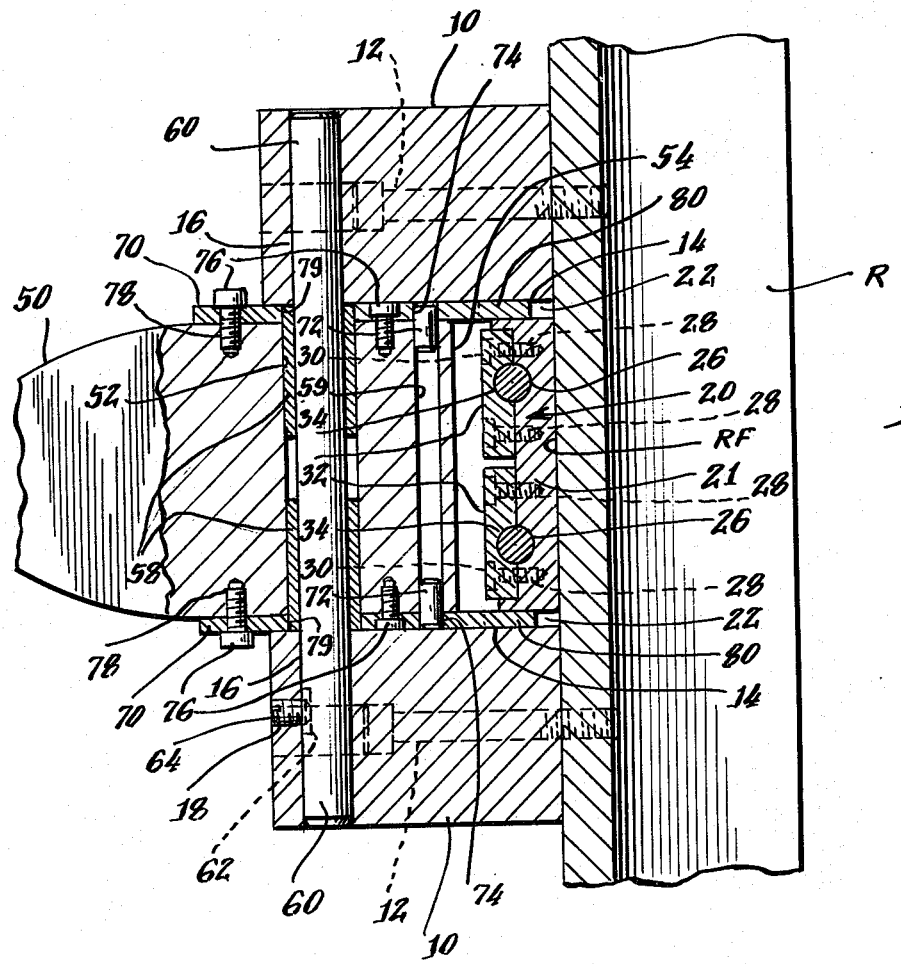
Fig. 8.

MULTI-STATION TRANSFER PRESS HAVING PUNCH EXTENDING MEANS

BACKGROUND OF THE INVENTION

The invention relates to multi-station strip metal forming presses of the type including a vertically reciprocating ram for mounting and operating the tools. These presses are well suited for the manufacture of metal parts made sequentially in a succession of drawing operations at the stations. In this type of machine, coil strip stock is fed in widths from a fraction of an inch through up to seven inches on the larger machines. Blanks are automatically cut from the strip, and vertical blank transfer mechanism positively holds and carries the blank down to the transfer level, where it is picked up by the transfer fingers of a horizontal transfer mechanism. Usually the blank is transferred through a succession of draw dies in as many as fifteen individual work stations and, finally, ejected as a completed part. This type of completely automatic operation allows piercing, forming, drawing, lettering, embossing and flanging, as well as side slotting, side piercing and reverse drawing at production rates which have exceeded 250 parts per minute. From blanking operation to finished part ejection, all tooling is mounted in standardized precision die sets to facilitate set up and minimize down time. Each station may be individually adjusted or serviced. Complete die sets can be interchanged without losing tool adjustment. Frequent complete change of jobs or intricate toolings will justify extra die sets.

An example of an early press of this type developed by the assignee of the instant application which sets forth the essential nature of this type of press is found in U.S. Pat. No. 2,049,915 dated Aug. 4, 1936, in the name of Arthur J. Lewis and assigned to the assignee of the instant application. Of course, a large number of improvements have been made since the issuance of the Lewis patent, primarily with a view toward producing higher speeds, lower ultimate tooling costs, precision operation, tool adjustment and replacement, minimizing down time, minimizing scrap loss and, in general, providing greater versatility and operational sophistication for the presses.

The type of press to which my invention pertains, for practical and economic reasons, comes in a limited number of configurations, that is, size, tonnage capability, size of stock which may be accommodated and the ultimate size of the part which may be manufactured on the press, including the maximum draw that can be made on a part. Although there are a number of variables that enter into the maximum draw that may be formed on a press of the type involved, such as the metallurgy of the strip material of which the part is being formed, one of the critical inhibiting factors is the inherent configuration of the machine. The amount of draw permitted by any given press is the result of the longest ram-tool stroke that can be achieved in any given size machine. For example, there is here reproduced a specification chart setting forth the specifications of five different size Multiple Transfer ® presses that are manufactured by the assignee of the instant application, which do not include my inventive double punch extender.

SPECIFICATIONS

Specifications-Multiple Transfer Presses

| Size of Press | | 2-19 | 3-25 | 4-37 | 5-51 | 5L-51 |
|---|---|---|---|---|---|---|
| Rated machine capacity | tons | 15 | 25 | 45 | 75 | 75 |
| | (kg) | (13608) | (22680) | (40823) | (68039) | (68039) |
| Stroke of ram - normal | inches | 1 1/2 | 2 | 2 1/2 | 3 | 7 |
| | (mm) | (38.1) | (50.8) | (63.5) | (76.2) | (177.8) |
| Stroke of ram - max. | inches | 2 | 3 | 5 | 5 | 7 |
| | (mm) | (50.8) | (76.2) | (127) | (127) | (177.8) |
| Shut height space for die set | inches | 8 5/8 | 10 | 14 1/2 | 18 | 20 |
| from ram step to press bed | (mm) | (219.08) | (254.00) | (368.30) | (457.20) | (508.00) |
| Ram width | inches | 18 7/8 | 24 7/8 | 36 7/8 | 50 7/8 | 50 7/8 |
| | (mm) | (479.4) | (631.8) | (936.6) | (1292.2) | (1292.2) |
| Transfer stroke - normal | inches | 1 3/4 | 2 | 3 | 3 1/2 | 4 or 4 1/2 |
| | (mm) | (44.45) | (50.8) | (76.2) | (88.9) | (101.6 or 114.3) |
| Transfer stroke - max. | inches | 2 1/2 | 3 | 4 1/2 | 5 1/2 | 5 1/2 |
| | (mm) | 63.5) | (76.2) | (114.3) | (139.7) | (139.7) |
| Motor HP & motor RPM | | 3-1750 | 5-1750 | 10-1150 | 10-1150 | 15-1150 |
| Speed range - strokes per min. | | 105-275 | 110-260 | 60-160 | 40-90 | 40-90 |
| Floor space side to side | inches | 48 | 58 1/4 | 87 1/2 | 113 1/4 | 113 1/4 |
| | (mm) | (1220) | (1480) | (2220) | (2880) | (2880) |
| Side to side with OSHA guards | inches | 61 | 76 1/2 | 103 | 121 | 121 |
| | (mm) | (1550) | (1940) | (2620) | (3070) | (3070) |
| Floor space front to rear | inches | 28 1/2 | 33 1/2 | 62 1/2 | 64 1/2 | 64 1/2 |
| | (mm) | (725) | (850) | (1590) | (1640) | (1640) |
| Front to rear with OSHA guards | inches | 51 | 62 | 68 | 81 | 81 |
| | (mm) | (1300) | (1575) | (1730) | (2060) | (2060) |
| Overall machine height | inches | 74 1/4 | 79 3/4 | 102 3/4 | 116 1/4 | 116 1/4 |
| | (mm) | (1886) | (2026) | (2610) | (2953) | (2953) |
| Height with OSHA guards | inches | 81 1/4 | 88 3/4 | 111 | 125 1/2 | 125 1/2 |
| | (mm) | (2064) | (2255) | (2820) | (3188) | (3188) |
| Net weight with die set | lbs. | 3350 | 5400 | 14500 | 25400 | 26500 |
| | (kg) | (1520) | (2450) | (6580) | (11520) | (12020) |
| Shipping weight | lbs. | 3650 | 5700 | 15000 | 25900 | 27000 |
| | (kg) | (1656) | (2585) | (6800) | (11750) | (12250) |
| Maximum width of | inches | 3 1/4 | 3 7/8 | 4 1/2 | 6 5/8 | 6 5/8 |
| metal stock from roll feed | (mm) | (82.55) | (98.43) | (114.3) | (168.6) | (168.6) |
| Maximum length of | inches | 2 3/4 | 3 | 3 1/4 | 4 | 4 |
| stock from roll feed | (mm) | (69.85) | (76.2) | (82.55) | (102) | (102) |
| | | Max Ram | Max Ram | Max. Ram | Max. Ram | Max. Ram |

SPECIFICATIONS-continued

Specifications-Multiple Transfer Presses

| | Draw | Stroke | Draw | Stroke | Draw | Stroke | Draw | Stroke | Draw | Stroke |
|---|---|---|---|---|---|---|---|---|---|---|
| *Longest draw with norm. ram stroke | 5/8 (15.9) | 1 1/2 (38.1) | 11/16 (17.5) | 2 (50.8) | 1 (25.4) | 2 1/2 (63.5) | 1 1/4 (31.8) | 3 (76.2) | 3 (76.2) | 7 (177.8) |
| *Maximum draw with maximum ram stroke | 13/16 (20.6) | 2 (50.8) | 1 1/4 (31.8) | 3 (76.2) | 1 5/8 (41.3) | 4 (101.6) | 2 1/4 (57.2) | 5 (127.) | 3 (76.2) | 7 (177.8) |

| No. of Stations | Die Width or Tr. Stroke in. (mm) | Max Blank Diameter in. (mm) | Max. Blank Diameter in. (mm) | No. of Stations | Die Width or Tr. Stroke in. (mm) | Max Blank Diameter in. (mm) | Max. Blank Diameter in. (mm) |
|---|---|---|---|---|---|---|---|
| | Press Size 2-19 | | | 9 | 4 (101.60) | 2 1/2 (63.50) | 2 3/4 (69.85) |
| 7 | 2 1/2 (63.50) | 1 1/2 (38.10) | 1 3/4 (44.45) | 10 | 3 1/2 (88.90) | 2 1/4 (57.15) | 2 3/4 (69.85) |
| 9 | 2 (50.80) | 1 1/4 (31.75) | 1 3/4 (44.45) | 12 | 3 (76.20) | 2 (50.80) | 2 1/2 (63.50) |
| 10 | 1 3/4 (44.45) | 1 (25.40) | 1 7/16 (36.51) | 14 | 2 1/2 (63.50) | 1 1/2 (38.10) | 2 (50.80) |
| 11 | 1 1/2 (38.10) | 3/4 (19.05) | 1 7/16 (36.51) | | Press Size 5-51 | | |
| | Press Size 3-25 | | | 9 | 5 1/2 (139.70) | 3 1/4 (95.25) | 3 3/4 (95.25) |
| 8 | 3 (76.20) | 2 (50.80) | 2 1/4 (57.15) | 10 | 5 (127.00) | 3 1/4 (82.55) | 3 3/8 (85.73) |
| 9 | 2 1/2 (63.50) | 1 1/2 (41.28) | 2 1/4 (57.15) | 11 | 4 1/2 (114.30) | 2 1/4 (69.85) | 3 1/8 (85.73) |
| 11 | 2 (50.80) | 1 1/4 (31.75) | 1 7/8 (47.63) | 12 | 4 (101.60) | 2 1/2 (63.50) | 3 1/8 (85.73) |
| 13 | 1 3/4 (44.45) | 1 (25.40) | 1 7/8 (47.63) | 14 | 3 1/2 (88.90) | 2 1/4 (57.15) | 3 (76.20) |
| 15 | 1 1/2 (38.10) | 1/4 (19.05) | 1 1/2 (38.10) | | Press Size 5L-51 | | |
| | Press Size 4-37 | | | 11 | 4 1/2 (114.30) | 2 3/4 (69.85) | 3 7/8 (98.43) |
| 8 | 4 1/2 (114.30) | 2 3/4 (69.85) | 2 3/4 (69.85) | 12 | 4 (101.60) | 2 1/2 (63.50) | 3 7/8 (98.43) |

*When full size blank must be transferred to 2nd Station.
*When blank and cup operation is performed at 1st Station.

It is the purpose of my invention to extend the maximum draw that may be obtained with any given machine and to increase it beyond its maximum as set forth in the foregoing chart by the incorporation of my unique double punch extender into the press. It will be understood that for many part manufacturing operations, for example, a thin aluminum part, a smaller size machine may have adequate tonnage, but inadequate maximum draw capacity. It is in these situations that the utilization of my double punch extender has the effect of permitting a smaller size machine to produce a part of a drawn length that would otherwise require the next larger size machine. Obviously, this is a great advantage to owners of existing presses of the type involved, for it enhances the ability of their presses to manufacture larger parts, i.e., parts that are larger in drawn length than they otherwise could form in the absence of my double punch extender.

SUMMARY OF THE INVENTION

Presses of the type to which my invention pertains have been employed for many years. Those knowledgeable with these presses agree that the maximum length of a part drawn in these presses is somewhat less than half the length of the press ram stroke. The actual maximum length which can be drawn depends upon the shape of the top portion of the work piece. It is a rule of thumb of and generally agreed by those skilled in the art that a part can not be drawn in one of these presses to a greater length than 43 percent of the press stroke on my assignee's No. 2-19 and No. 3-25 M.T.P. presses, and perhaps 45 percent on the No. 4-37 and No. 5-51 M.T.P. presses (See Chart).

By the incorporation of my invention into presses of the type involved, it is possible to draw parts to over half of the length of the ram stroke. Improved presses according to my invention involve the substitution, for two of the otherwise existing drawing tools that are disposed at central work stations and carried by and operated by the press ram so as to be fixed relative to and jointly movable with the ram, of two drawing tools that are mounted movably relative to the ram. In addition to simultaneously moving vertically with the ram, the movably mounted pair of driving tools move vertically relative to the ram in the same direction as the ram moves, to thereby increase the vertical movement of the movably mounted drawing tools beyond that which they would move if they were mounted in fixed position relative to the ram, as are the remainder of the tools. This allows them to move vertically downwardly a greater distance than if they were fixedly mounted relative to the ram and thereby produce a greater length of draw.

The two movable drawing tools are carried by a vertically movable plunger block that is slideably mounted in a slideway formed by the ram and a pair of bearing blocks that are securely attached to the face of the ram. A drive lever is mounted on a fulcrum pin that extends horizontally and is supported by the two bearing blocks. The fulcrum pin moves with the ram simultaneously and to the same vertical extent. The inner end of the lever is in driving engagement with the plunger block. The lever extends away from the ram at the front of the press and at its outer end it is pivotally attached to a link which has its other end attached to a bracket that is secured to the front of the press frame. The arrangement is such as to restrain the outer end of the lever so that it can not move significantly though its pivot connection with the link is permitted some slight movement. The inner end of the lever is positioned inboard of the fulcrum pin. In operation, the mechanical movement effected by the ram-plunger block-fulcrum pin-lever-link mounting is such that the inner end of the lever moves a greater vertical distance than the ram for any given ram stroke, and this additional amount of travel is the essence of the extended motion which is provided by my invention.

The drive connection between the lever and plunger block is formed by teeth means attached to the inner end of the lever which mesh with drive notches formed in the plunger block to drive it vertically in the slideway relative to the ram when the ram moves. The vertical movement of the plunger block relative to the ram is in the same direction as the ram moves and corresponds to the extra travel of the inner end of the lever. With this arrangement, when the ram moves vertically downwardly it carries the fixed tools with it to the same extent as in the prior art presses, but the two movably mounted drawing tools are moved an additional vertical increment downwardly, and therefore, will project into the dies of the press an additional amount, which constitutes the increased amount of draw of the parts being made.

OBJECTS OF THE INVENTION

It is an object of this invention to provide a means for existing multi-station strip metal transfer presses that will enable them to produce longer drawn parts to those which may otherwise be produced on existing presses of the same configuration and size.

It is another object of the invention to provide an improved multi-station strip metal transfer press having means for and the capability of extending the amount of vertical movement of at least two of the drawing tools relative to that otherwise permitted by existing presses of the same configuration and size, to thereby increase the drawing capacity of the press.

Other and more particular objects of the invention will in part be obvious and will in part appear from a perusal of the following description of the preferred embodiments of the invention and the claims taken together with the drawings.

DRAWINGS

FIG. 7 is a plan view showing a portion of the ram, the plunger block, positioning and drive lever for the plunger block and related components.

FIG. 8 is a sectional view taken substantially on lines 8—8 of FIG. 5.

Figure 9:
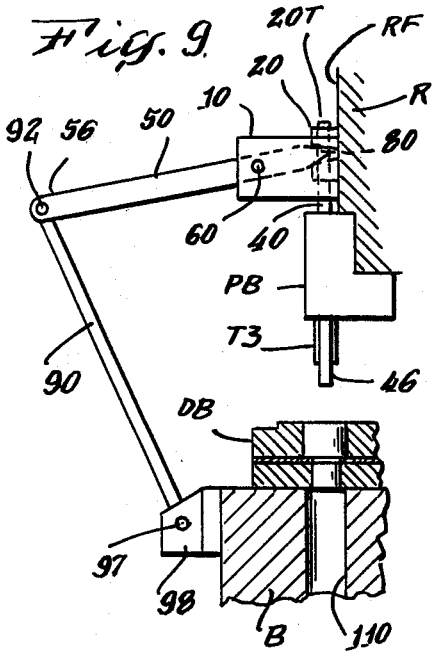
Figure 10:
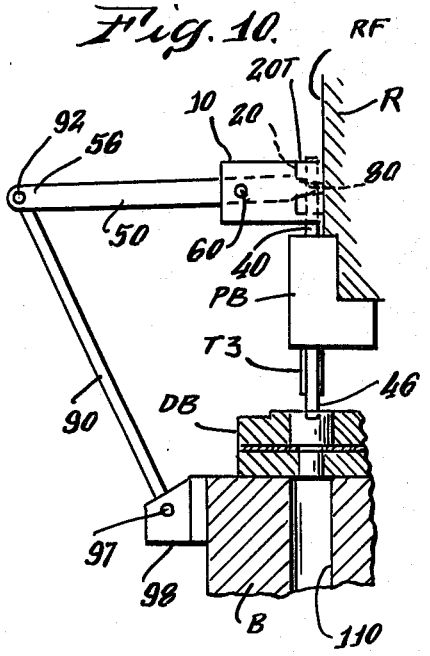
Figure 11:
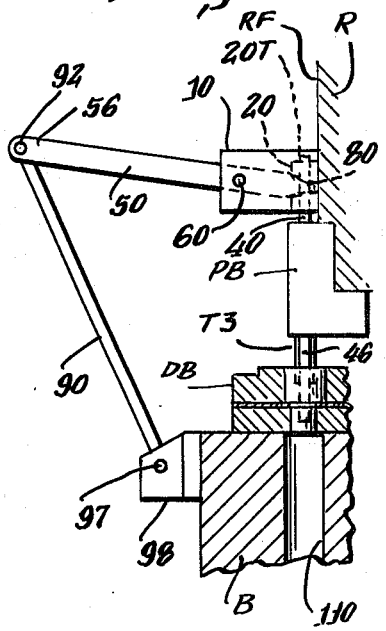

FIGS. 9, 10 and 11 are schematic views showing the relative positioning of the ram, the plunger block and the positioning and drive lever in three representative positions assumed during operation with the corresponding positions of a fixed punch and an extended punch relative to the die holder; FIG. 9 showing the uppermost position of the ram, plunger block, lever and punches, FIG. 10 showing an intermediate position of these parts, and FIG. 11 showing the lowermost position of these parts.

Figure 12:
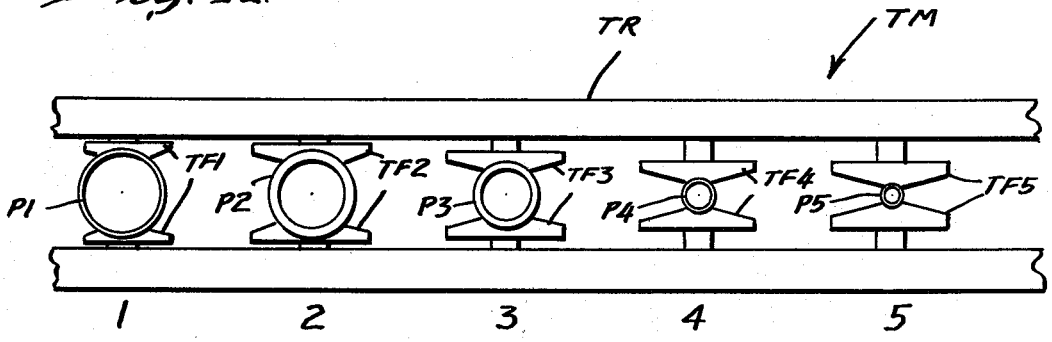

FIG. 12 is a fragmentary plan view of the transfer means of the press showing parts being gripped by the transfer fingers at the sequential stations of the press.

Figure 13:
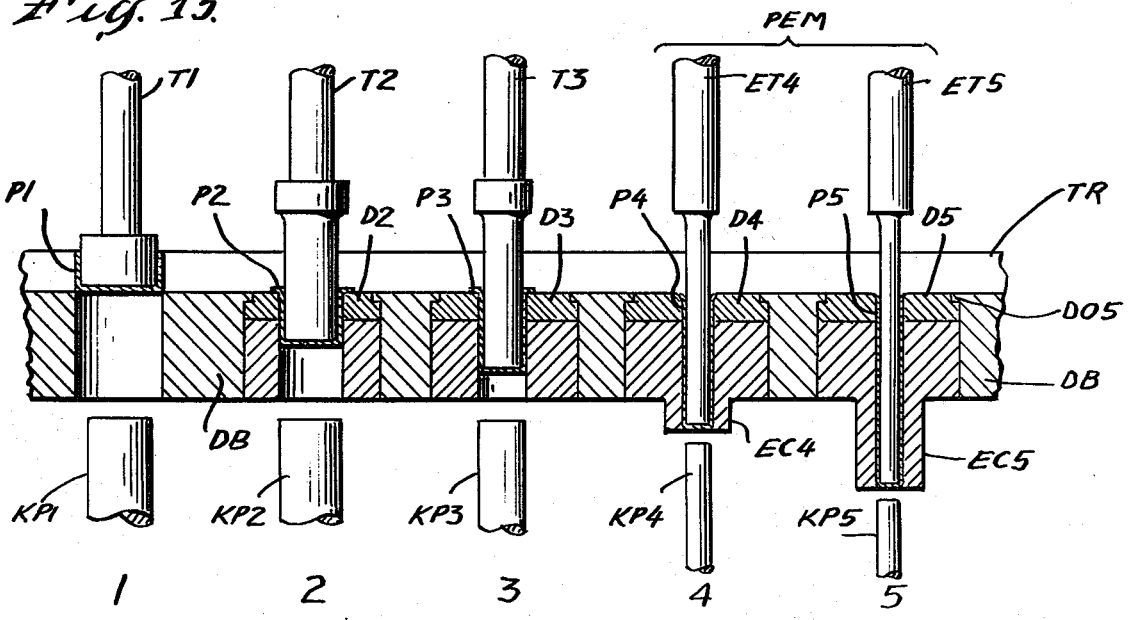

FIG. 13 is a fragmentary vertical sectional view taken through the punch and die means of a press equipped with my invention when operatively positioned to perform work on a work piece at the illustrated stations 1 through 5 with a work piece shown in position at each station in the shape to which it has been formed.

DESCRIPTION OF PREFERRED EMBODIMENT

Figure 1:
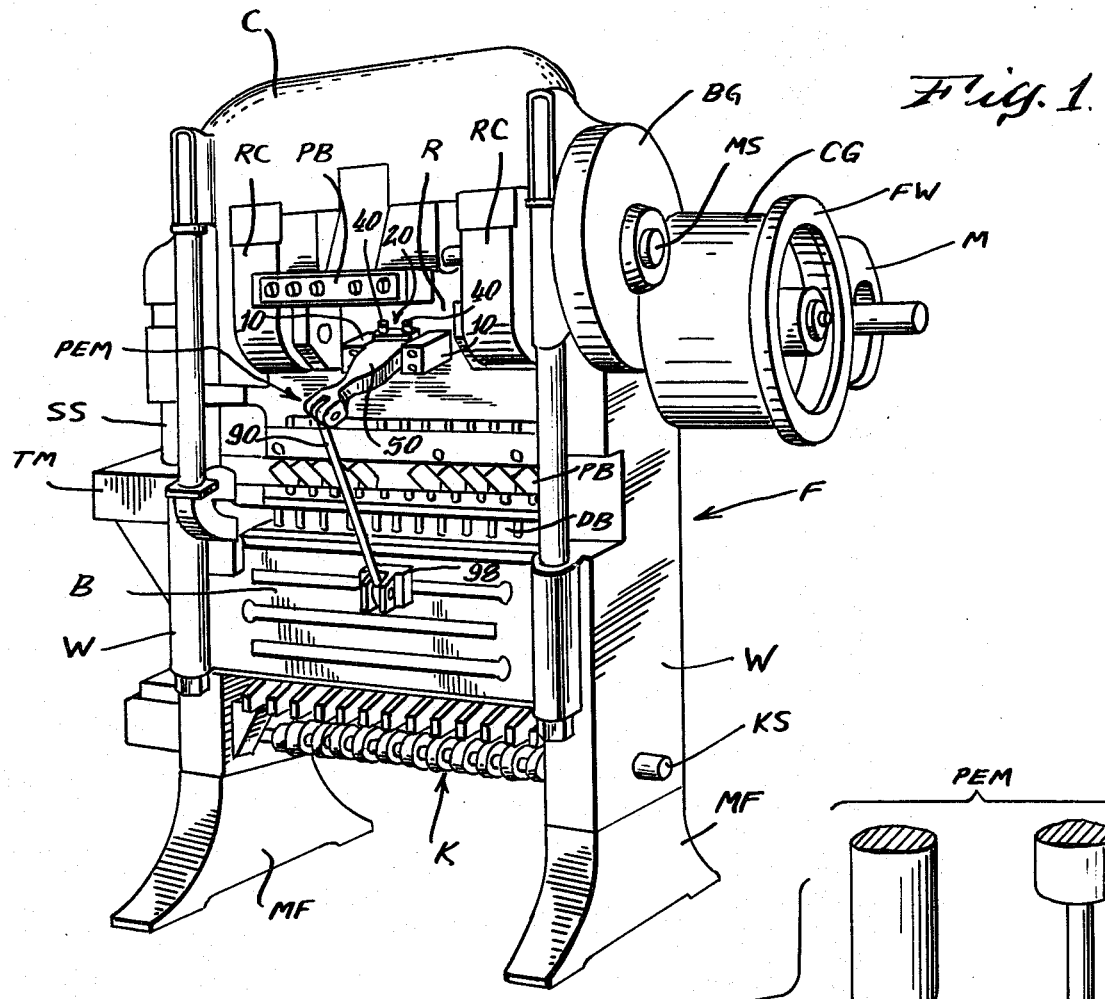
FIG. 1 is a front perspective view of a multi-station strip metal forming transfer press which incorporates my double punch extender invention.

FIG. 1 illustrates in perspective the top, front and one side of a transfer press which has my invention incorporated in it. It should be clearly understood that other than for the detailed description of the construction and operation of my improved punch extending mechanism PEM, the remainder of the transfer press which is illustrated and which will be described herein, is for illustrative purposes only. The principal purpose of my invention is to increase the drawing capability of a transfer press of the type disclosed and claimed in the referred-to Lewis patent and manufactured by my assignee as Multiple Transfer ® presses in several sizes and configurations.

The transfer press TP comprises a frame F which includes at its top a generally horizontally extending crown C supported by a pair of rugged side walls W which extend vertically and at their lower ends are formed with mounting feet MF. Spaced upwardly from the feet of the press is a solid press bed B that extends horizontally between and is supported by the walls W. Mounted for predetermined controlled vertical reciprocation below the crown C and between walls W is the ram R. The ram is mounted in appropriately provided guideways for controlled vertical reciprocation and is operatively associated with the press bed B to effect work on work pieces. A die set of the self-contained interchangeable type is mounted in the press with its die block portion DB being rigidly secured to the bed B and its punch block PB being secured to the ram R. As is well known in the art, the die bed DB is stationary and the punch block PB vertically reciprocates with the ram R relative to the die block. Dies are mounted in positions to be operatively associated with punch tools that are mounted in fixed position on the punch block PB and which, therefore, vertically reciprocate with the ram and punch block relative to the die block and dies mounted therein. The ram is vertically reciprocated by known ram cam and rollers mechanism that is mounted within the housings RC. The ram cams are mounted on a cam shaft MS. The drive for the cam shaft MS comprises a bull gear which is mounted within the housing BG, a fly wheel FW and a motor M which is the main source of power for operating the press. The power drive includes an air clutch-brake mounted within the guard CG, of known construction. The press includes a vertically extending side shaft SS for driving various subassemblies, such as the metal strip feed and the work piece transfer mechanism, which at its upper end through a bevel gear arrangement is driven by the cam shaft MS. At its lower end the side shaft SS drives a horizontally reciprocable transfer mechanism, of known construction, which is disposed within the housing TM. The construction and operation of the side shaft, its beveled drive connection with the cam shaft and its driving connection with the transfer mechanism are all known. The press includes appropriate metal strip feed mechanism (not shown), an assembly of lower knockout mechanism K and may include additional features, such as an upper knockout attachment, punch strippers and other attachments or accessories, all known in the art. The press is controlled by an appropriate array of pushbuttons on a panel PB and my punch extender mechanism is generally indicated as PEM. Other parts shown in FIG. 1 may conventionally appear in known transfer presses, however, they form no part of my invention and therefore will not be described. None of the foregoing press construction constitutes any specific part of my invention; however, it is the type of press environment in which my invention is incorporated.

Figure 2:
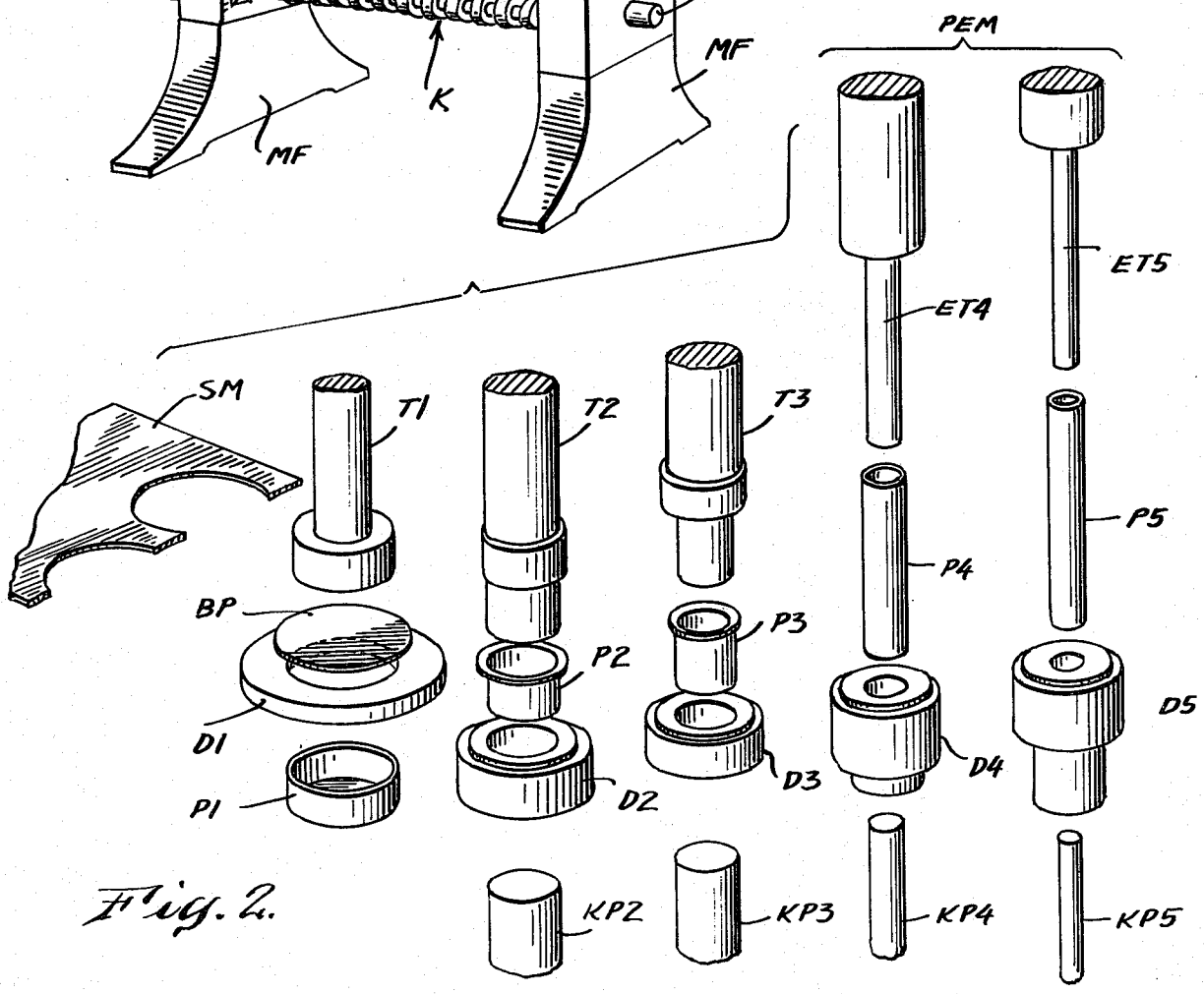
FIG. 2 is a somewhat schematic view of portions of a transfer press which incorporates my invention showing a work piece and the punches, dies and knockout plungers at the first five work stations of the press.

In FIG. 2 there is somewhat schematically illustrated a hypothetical transfer press application with tooling for manufacturing elongated cylindrical parts P1–P5. FIG. 2 illustrates five work stations, 1, 2, 3, 4 and 5, and each of the stations comprising a die D and an associated punch tool T, which in the case of the punch tools mounted at stations 4 and 5, are extended punch tools that operate in the unique manner afforded by my invention to increase the amount of their downward movement in operation to thereby produce a longer drawn part, as will hereinafter be explained in greater detail. Throughout, the reference letter characters for the tools, dies and part as it progresses through the press are designated with a numeral suffix which corresponds with the station number. The first station may be a combination punch blanking and forming station, rather than simply a blanking station as generally mentioned hereinabove, in which event the blank BP is first blanked out of a metal strip SM that is fed to the press by the feed mechanism, (not shown), and, thereafter, formed into cup-shaped part P1, all at the first station. The part P1 is designated as P2, 3, 4 or 5 dependent upon its station location, as it sequentially progresses through the transfer press. In stations 2, 3, 4 and 5, as in all other forming stations other than station 1, a lower knockout plunger KP2–KP5 is illustrated, which functions in a known manner. The tools T and dies D are sequentially numbered in accordance with their station, and are configured differently in accordance with the different work operation to be performed on the part P at the given station.

FIG. 2 illustrates in a somewhat pictorial manner, the part forming elements of the press to form the elongated cylindrical part P5 through the stations illustrated. However, it will be understood that the part P5 will be sequentially transferred to further stations 6, 7 and 8 and, in fact, as many as are reasonably desired for performance of additional work on the part at each station. For example, work on the top of the cylindrical part may be performed in a subsequent normal station with a short punch as a guide which does not extend all the way down to the bottom of the overlong cup. Work that needs to be performed deep inside the cup can be performed with a long punch with the cup only part way down in the die. Therefore, it is only necessary to have two of the punches ET, shown at stations 4 and 5 capable of the extended punch operation.

It is understood by those skilled in the art, that the blank BP, and the part P thereafter formed out of the blank, sequentially is indexed, i.e., transferred one station at a time in a predetermined controlled timed manner; that when in full operation, the press has a work piece at each station which constitutes a part that has been formed up to the point of forming to that station, and that additional work is performed on the part at each station. The transfer of the work piece is effected by a transfer mechanism TM of known construction and operation in the art, which is partially illustrated in FIG. 12. It comprises a pair of spaced transfer rails TR that extend horizontally, and support on their opposing sides inwardly biased spring pressed transfer fingers TF. The arrangement is such that the transfer mechanism reciprocates horizontally in timed relation with the vertical operation of the tools T and knockout plungers KP to the functional end result of transferring a work piece one station at a time, i.e., moving a work station for having work performed thereat, and after the work has been performed, moving the work piece to the next station until the part is finished. In FIG. 12 and FIG. 13, the same part is shown at stations 1, 2, 3, 4 and 5 as it progresses through the press. The same numerical suffix designations for the stations at which the part and components are located are provided in FIGS. 12 and 13 as to correspond to those in FIG. 2. In FIG. 13 a part P is shown as it is formed at a given station, and in FIG. 12, the transfer mechanism at the same station is shown gripping the part in such form and poised to transfer it to the next station.

My improved punch extender means PEM will now be described in detail with reference to FIGS. 3 to 11, particularly, FIG. 3. In these figures, latter reference characters previously employed to designate parts of the transfer press will continue to be used, and will serve to facilitate structural orientation of my invention in the press, as well as interrelated operational functioning. Central portions of the ram R, die set DB-PB and press bed B, and my punch extender mechanism PEM, are shown in front perspective in FIG. 3. The front face portion of the ram R is planar and designated RF. The die block DB of the die set is rigidly secured to the press bed B at its top. The die bed DB generally is formed in a known manner, and supports on its top a plurality of die holder keys DK on which die holders DH are positioned which are positioned by die holder adjusting blocks DAB that are adjusted by die holder adjusting screws DAS and secured in position by die holder retaining screws DHS. The dies are securely positioned by the die holder screws DHS which extend through vertical bores OH in the die holders DH and aligned openings OK in the die holder DK and are anchored in die bed openings OB. The die holders DK include die retaining openings DO which communicate with die chambers DC of slightly larger diameter for locating and positioning the dies, which may be two-piece dies, die D4 located at station 4 being shown in FIG. 3. The die holder keys DK and the die bed DB have formed in them aligned openings DCK and DCB, respectively. The construction and arrangement of the die block and its components are essentially the same as that in the prior art, with a modification to be subsequently described in detail to the dies and knockout mechanism at stations 4 and 5 to accommodate the longer drawing punch tools ET4 and ET5 to permit longer drawing operations to be performed on a work piece at stations 4 and 5 (see FIG. 13).

The punch block PB, other than for the drawing tools ET4 and ET5 and their associated mounting and operating components located at stations 4 and 5, is constructed and operates in generally the same manner as in prior art transfer presses. A plurality of tools are fixedly mounted to extend downwardly from punch block PB, punch tools T2, T3, T6 and T7 being illustrated in FIG. 3, which correspond to those in prior art die sets. As they are mounted in fixed position on the punch block PB, they are disposed in fixed position relative to the ram R, as the punch block is rigidly connected to and moves with the ram. More particularly, all the tools other than extended punch tools ET4 and ET5 which form part of my punch extender mechanism, are mounted in punch holders PH that, in turn, are clamped to the punch block PB by the clamps PC and appropriate clamp screws PCS. Appropriate adjusting screws PCA are mounted in threaded vertical bores in and accessible from the top of the punch block PB, for adjusting the vertical position of these tools prior to their being clamped in operative position. The punch block PB is appropriately positioned on the ram R by the locating key PBK.

Figure 5:
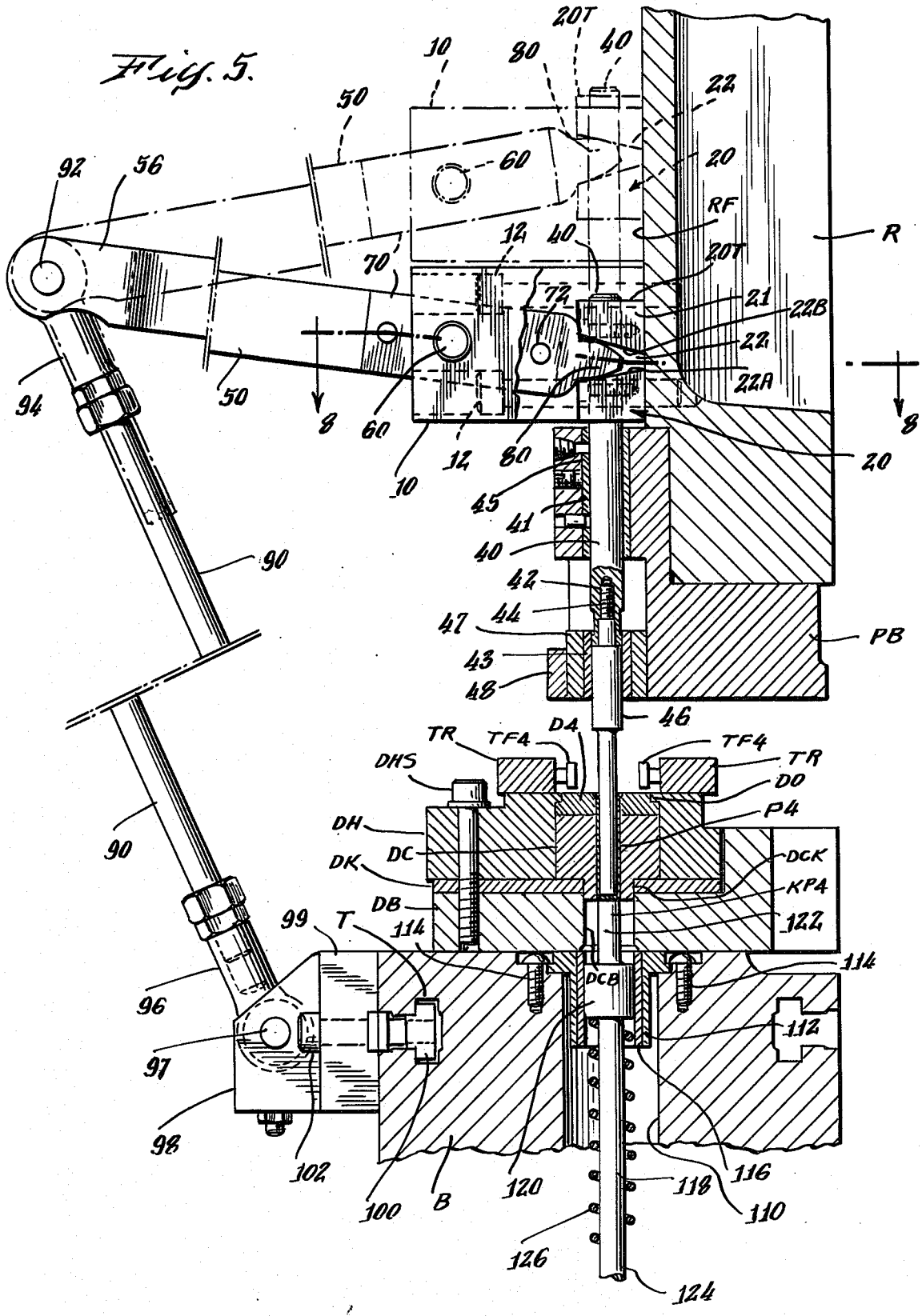
FIG. 5 is a view similar to FIG. 4 on an enlarged scale and showing in section the detailed construction of the punch extender mechanism in its lowermost position to which it may be moved in solid lines, and in its uppermost position to which it may be moved in dotted lines.

At stations 4 and 5 of the punch block PB, instead of the conventional fixed tools, there are movably mounted extended punch tools ET4 and ET5, respectively. These tools are not fixed relative to the punch block PB or the ram R, but mounted so as to be movable relative thereto in operation. In operation, on the downward stroke of the ram R, it moves downwardly and the tools it carries move into the die bed DB into the dies positioned therein. As will become apparent, the extended tools ET4 and ET5 are moved by my punch extender mechanism a greater distance than the ram, the punch block and tools that are affixed to the punch block jointly move. The additional increment of vertical downward movement of the extended tools ET4 and ET5 is provided by my punch extender mechanism PEM. Centrally of ram 4, to its face RF there is rigidly mounted a pair of spaced bearing blocks 10. The rigid connection is effected by a plurality of mounting bolts 12, the heads of which are recessed in the bearing blocks. The front of the ram face RF is machined smoothly into a good bearing surface, as are the opposing faces 14 of the bearing blocks 10. The portion of the ram face RF between the bearing blocks 10, and the adjacent surfaces of opposing walls of the bearing blocks 10 comprise in plan view a U-shaped, three-sided, vertically extending slideway for a plunger block 20 that carries the extended punch tools ET4 and ET5. The plunger block 20 comprises pinch bind block 21 and pinch bind clamps 32. Block 21 comprises driving notches 22 at its ends and a central pinch bind portion 24 (see FIG. 6). A pair of spaced vertically extending half-round grooves 26 are formed on one side of the block 21, which further includes a plurality of threaded openings 28 for receiving the pinch bind clamping screws 30 that extend through the pinch bind clamps 32 to clamp the latter to the block 21 (see FIG. 8). The clamps 32 each have a half-round groove 34 which is alignable with one of the grooves 26 in the pinch bind block 21. The pinch bind clamps 32 in cooperation with the pinch block 21 cooperate to form supporting means of the plunger block 20 for a pair of vertically downwardly extending plungers 40, each of which at its lower end supports an extended punch tool ET4 and ET5. The connections between the plungers 40 and the extended tools ET4 and ET5 may be effected by threaded sockets 42 formed in the bottom of the plungers and a threaded stub shaft 44 at the upper ends of the extended tools, as can be seen in FIG. 5. The plungers 40 and their supported extended tools are movably supported for vertical movement by and relative to the punch block PB as will be subsequently described in greater detail.

As described thus far, it will be understood that the plunger block 20 comprises an assembly of the pinch bind block 21 and the pinch bind clamps 32 that is configured so as to securely support a pair of depending plungers 40. Plunger block 20 snugly fits in the slideway formed by the ram face RF and the adjacent portions of the opposing walls 14 of bearing blocks 10. The fit is such as to provide a good bearing interface to permit, in operation, the plunger block 20 to reciprocate vertically relatively to the ram R in the slideway as the ram reciprocates, as will become apparent.

In order to retain the plunger block 20 in position in the slideway and, further, drive it either vertically upwardly or downwardly relative to the ram R during reciprocation of the ram to provide for its extended movement vertically in excess of the amount that the ram moves, the plunger block 20 operatively is associated with a positioning and driving lever 50. Lever 50 is mounted for a restricted amount of pivotal movement relative to the bearing blocks 10 by being mounted on a fulcrum pin 60 that is supported by the bearing blocks as illustrated in FIGS. 3 and 8. The fulcrum pin 60 extends through a transverse bore 52 formed in the lever 50, openings 79 in plates 70 to be described and bores 16 in the bearing blocks. The mounting of the lever 50 on fulcrum pin 60 is such that one of its ends, hereinafter referred to as the inner driving end 54, is closer to the fulcrum pin than its other end, hereinafter referred to as the outer end 56. FIG. 8 shows how the lever 50 is mounted on the fulcrum pin 60 in clear detail. It will be seen that bushings 58 are centrally disposed in the lever bore 52 to support the fulcrum pin 60 and, further, that a locating and setting notch 62 is positioned near one end of the fulcrum pin so as to be alignable with a set screw 64 that extends through an appropriately threaded opening 18 in one of the bearing blocks 10 to position and fix the fulcrum pin in operating position.

The lever inner end 54 is disposed adjacent to, but does not directly contact the plunger block 20; however, it carries on its opposite sides, a pair of plunger block mounting-driving plates 70. The plates 70 are rigidly secured to the inner end 54 of the lever 50, as by locating plugs 72 that extend through and are positioned in aligned openings 74 in the plates 70 and bore 59 in the lever 50, and mounting screws 76 that extend through openings 78 in the plates 70 and are anchored in the sides of lever 50. As can be best seen in FIGS. 3 and 6, each of the forward ends 80 of the plates 70 is formed in the shape of a single involute gear tooth that is disposed, respectively, in a driving notch 22 of the pinch bind block 21. It will therefore be understood that the fourth, otherwise open, side of the slideway for the plunger block 20 is closed by the interengagement of the teeth 80 with the notches 22. The notches 22 are formed by drive walls 22A and 22B which interengage with teeth 80 to securely position the plunger block 20 in the slideway. Further, they cooperate to provide a driving mechanism for moving the plunger block vertically in its slideway relative to the ram R and bearing blocks 10. The drive walls of the notches form what is functionally a single gear notch of the rack type, which cooperates with a single gear tooth of the pinion type, whereby arcuate movement of the "pinion" teeth 80 on pivoting of the lever 50 results in linear sliding of the plunger block.

Figure 3:
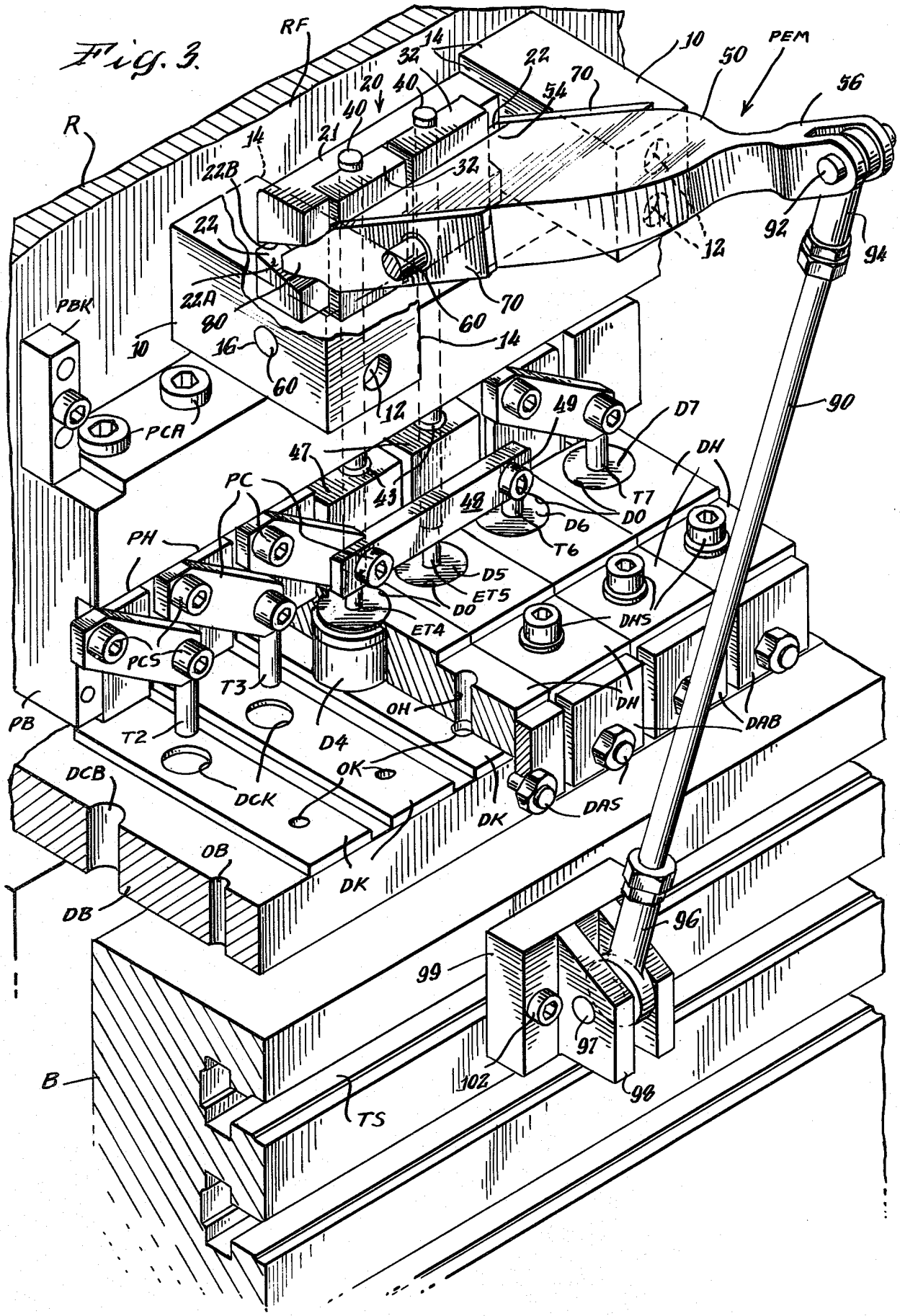
FIG. 3 is a fragmentary front perspective view on an enlarged scale of portions of the FIG. 1 transfer press highlighting my double punch extender invention.
Figure 4:
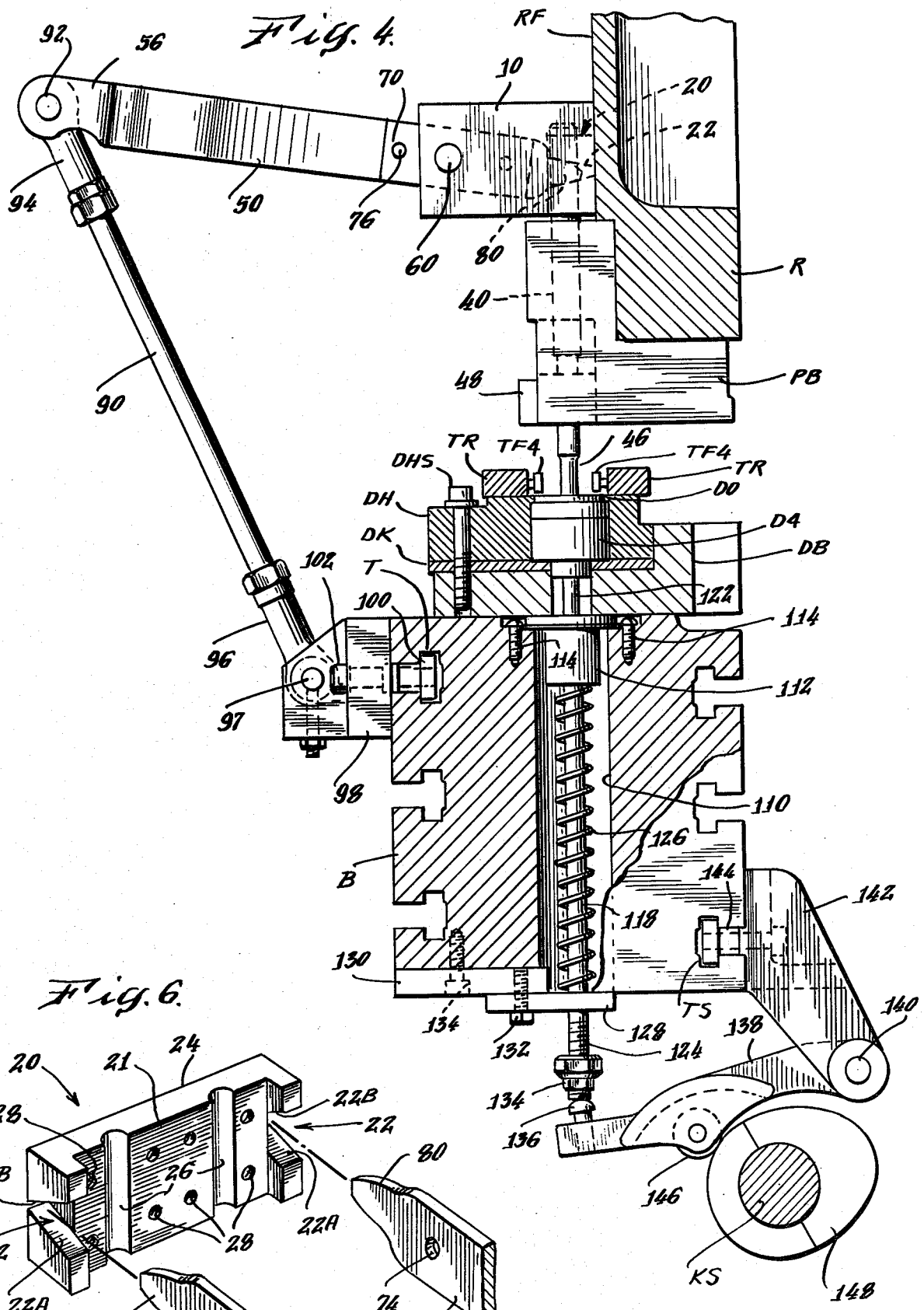
FIG. 4 is an enlarged vertical sectional view of the FIG. 1 press taken substantially through a work station at which one of my improved extended punches is located and showing the lower knockout mechanism.
Figure 6:
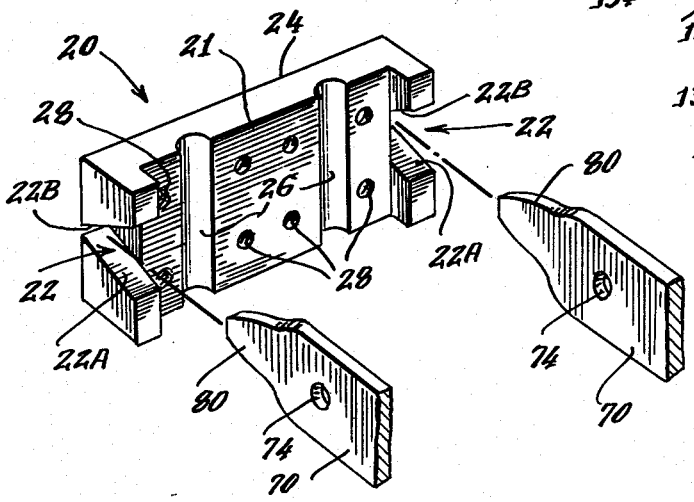
FIG. 6 is a fragmentary exploded view of the pinch bind block portion of the plunger block and the driving teeth of the driving plates that are carried by the positioning and drive lever.

In FIGS. 3 and 4, it will be seen that the outer lever end 56 is formed as a clevis and attached to the upper end 94 of an elongated link 90 by a clevis pin 92 so as to form a pivotal connection for the lever outer end and the link upper end, which may be in the form of an appropriate clevis joint. The lower end of the link 96 is formed so as to be pivotally receivable in the bracket 98 on pin 97. Bracket 98 is rigidly secured to the front of the press bed B by known fastening means for mounting accessories to the usual tee slots in the bed, such as a tee nut 100 and a cooperating bolt 102. The tee nut 100 is anchored in one of the tee slots TS, and the bolt 102 extends through an opening in the base 99 of the bracket 98. The configuration and mounting arrangement of the ram R, plunger block 20 and positioning and driving lever 50 are such as to cause the plunger block to move an additional vertical distance when the ram is moved, as will be subsequently described in greater detail.

In order to provide for the positive vertical upward movement of a part out of the die up to the level of the transfer mechanism after it has been worked upon at any given station, a lower knockout arrangement conventionally is provided. It can most clearly be seen in FIG. 4, where an arrangement for providing for positive removal of a part from a die at one of the stations is illustrated. It will be understood that a similar knockout arrangement is provided at all of the stations. As generally can be seen in FIG. 1, the knockout mechanism assembly K includes a plurality of knockout arrangements, one for each station. Therefore, a description of the knockout arrangement illustrated in FIG. 4 will generally suffice for all of the individual knockout arrangements. In FIG. 4 it will be observed that a two-piece die D4 is illustrated as being mounted in the die holder DH in position to receive the part to have extended drawing performed on the part by punch 46. During such drawing, the part is driven into the die D4 by the punch 46. Thereafter, the punch 46, in normal operation, will retract upwardly as the ram moves upwardly, and the part should be delivered by the normal spring bias of the knockout arrangement vertically upwardly to the level of and between the transfer fingers TE4, in order that it may be thereafter transferred to the next station (5). To insure the vertical upward movement of the part, the knockout mechanism of generally known construction is provided to effect positive movement. It comprises a vertical slot 110, in the upper end of which is mounted a knockout guide block 112 securely positioned by mounting screws 114 that are anchored in threaded openings in the top of the bed. Internally of the knockout guide block is mounted a bearing sleeve 116. Knockout rod 118 has an enlarged bearing portion 120 slideably mounted within the bearing sleeve 116, and an upwardly extending knockout pin portion 122 disposed in the opening DCB in the die block and to extend upwardly into the usual opening in the die D4. Below the bearing portion 120, the knockout rod has an elongated portion 124 of reduced diameter that extends downwardly. Around the elongated portion 124 is disposed a coil knockout spring 126, the upper end of which is in engagement with the lower end of the bearing portion 120, and the lower end of which is positioned by knockout spring plate 128 so as to mount the spring in compression. The plates 128 and 130 are mounted by appropriate securing screws 132, 134 anchored in the underside of the bed.

The knockout arrangement is such as to bias the knockout rod 118 upwardly at all times. The lower end 134 of the knockout rod 118 is formed so as to be engaged periodically by a headed rivet-like drive member 136 to move it upwardly in a positive predetermined manner. This is effected by periodic movement of knockout lever 138 which is pivoted at its end 140 which is opposite to its end which carries the headed drive member 136. The pivoted end 140 is pivotally mounted on a pin mounted in knockout bracket 142 that is secured to the lower back side of the bed B by known tee slot mounting mechanism generally designated 144. The knockout lever 138 carries a cam follower 146 which is operated by the knockout cam 148 driven by a lower horizontally extending knockout drive shaft KS. The construction and operation of the knockout mechanism is generally known and does not form any specific part of my invention. However, those skilled in the art will understand that it functions, as described, to provide for a positive upward movement of the part after it has been worked upon at any given station to prevent its being inadvertently jammed in locked position in the die after work has been done on the part when it must be moved upwardly to the level of and be gripped by transfer fingers of the transfer mechanism to move the part to the next station.

The normal operation of a transfer press of the type involved as it pertains to the tools that are fixed relative to the ram, such as tools T1, T2, T3, T6 and T7, is known, but will be briefly described. For the present, the operation of the extended punch tools ET4 and ET5 will be disregarded. The ram is caused to reciprocate vertically in predetermined timed relationship by the ram cam and roller arrangement RC driven by the main shaft MS which, in turn, is driven by the motor M through the clutch mechanism CG. The fixed tools move vertically jointly with the ram R and punch block PB relative to the die block DB an amount limited by the configuration and size of the press. Periodically the fixed tools are downwardly moved into associated dies, D1, D2, D3, D6 and D7 mounted in the die block DB at the respective stations 1, 2, 3, 6 and 7. The blank BP which has been blanked out of the strip SM fed to the first station of the press is worked and sequentially indexed by the transfer mechanism to each succeeding station, where additional work is performed on the part. The maximum downward movement of these conventionally mounted fixed tools T1, T2, T3, T6 and T7 limits the maximum amount of draw that can be effected on a part at stations 1, 2, 3, 6 and 7. With my invention incorporated into a transfer press, it will function in the known manner up to the station (as illustrated herein station 4) where my improved double punch extender mechanism is mounted. As it is convenient to mount my punch extender mechanism PEM centrally at the front of the press, my punch extender mechanism is illustrated as being located at stations 4 and 5. However, it should be clearly understood that it may be disposed at other stations, as long as there is sufficient clearance at the front of the machine to physically accommodate it and/or for it to function. For example, it must clear the ram cam and roller mechanism RC.

With reference to FIGS. 5 and 9–11, the manner in which my punch extender mechanism functions to provide for greater vertical movement of the extended punch tool 46 (ET4) disposed at station 4 will be explained. The extended punch tool 46 (ET5) located at station 5 operates in the same manner, but effects a deeper draw on part P5 because of the longer length of punch tool 46 (ET5) relative to punch tool 46 (ET4). The uppermost position of the arm is illustrated by dotted lines in FIG. 5 and schematically shown in FIG. 9. In this position, the plunger block 20 projects vertically above the tops of the bearing blocks 10. As the ram R is moved downwardly, it carries with it for identical joint vertical movement, the rigidly fixed bearing blocks 10 and the fulcrum pin 60. The plunger block 50 moves downwardly with the ram R with the same cam characteristics as the ram, but with a longer stroke as a result of an additional increment of downward movement caused by the driving connection between its drive notches 22 and the drive teeth 80 carried by the lever 50. As a result of the plunger block 20 being movably mounted in the slideway formed by a portion of the face of the ram RF and adjacent portions of the opposing faces of the bearing blocks 10, the plunger block 20 moves downwardly relative to the ram. This is caused by the pivotal movement of the lever 50, which results from the downward movement of its fulcrum pin 60, as the ram moves downwardly, and the essential constraint of the lever outer end 56 by its connection to the upper link end 94, which results in clockwise pivoting of the lever 50 and the consequential downward, slightly arcuate, movement of the lever inner driving end 54 and the drive teeth 80. This causes the involute driving teeth 80 to engage drive walls 22A of the drive notches 22, functioning as rack and pinion-like gearing therewith to drive the plunger block 20 within its slideway downwardly relative to the ram R and bearing blocks 10. Two relative positions, intermediate and lowermost, of the punch extension mechanism are shown in FIGS. 10 and 11 schematically. The lowermost positions are also shown in FIG. 5 in solid lines. It will be observed that as the ram moves downwardly, the relative positions of the plunger block 20, ram R and bearing blocks 10 changes, primarily in that the plunger block 20 occupies a position relatively lower than the ram R in FIGS. 10 and 11, sequentially, relative to their prior positions when the ram was in a higher position. In FIG. 11, the plunger block 20 is shown in its lowermost position, in which it is disposed relatively lower than the ram R. This may also be seen clearly in FIG. 5 where the plunger block 20 has been moved from its upward position in dotted lines wherein its top side 20T projects above the top of the bearing blocks 10, to its lower solid line position in which the plunger block 20 has been moved to a position wherein its top side has been moved downwardly relative to the top of the bearing blocks 10.

The amount that the plunger block 20 moves relative to the ram R is the additional increment of downward movement of a punch tool, such as extended tools 46, which are secured to the plunger rods 40 that are mounted in and move with the plunger block 20 relative to ram R and punch block PB. It will be observed that the plunger rods 40 are mounted in a pair of aligned vertically spaced bearing sleeves 41, 43 that are mounted in and at the front of the punch block PB. Bearing sleeve 41 comprises a bronze bearing sleeve that is threaded on its exterior to fit in the adjusting screw tap 45. Tap 45 otherwise exists in the punch block PB to receive a vertical adjusting screw for a fixedly mounted tool. At the two stations where the extended punch tools are disposed, the adjusting screws for the fixed tools that would otherwise be disposed there are removed and replaced by the bronze bearing sleeve 41. The bearing sleeve 43 is mounted in a bearing block 47 which is secured to the punch block PB by clamping strap 48. With reference to FIG. 3, the left hand end of strap 48 is notched and fits over the right hand end of the clamp PC that is mounted at station 3. Strap 48 is secured by the right hand bolt PCS of station 3 and bolt 49 disposed at its right hand end. The plunger rods 40 are slideably received in the bearing sleeves 41 and 43, hence are capable of vertical movement relative to the punch block PB, which is to be contrasted from the usual fixed mounting of the tools on the punch block, such as tools T1,T2,T3,T6 and T7, which move simultaneously, jointly and coextensively, with the punch block.

It will, therefore, be apparent that as the ram R vertically reciprocates, it moves the punch block PB and tools T1,T2,T3,T6 and T7 with it the same amount. At all positions of the ram R the fixed tools project downwardly from the ram and punch block the same amount. How, ever, during such ram movement, the extended punch tools 46 (ET4) and 46 (ET5) move downwardly more than the ram or punch block. The difference in vertical downward movement of a representative fixed tool T3 relative to an extended tool 46 can graphically be seen in FIGS. 9–11, wherein the amount tool T3 projects downwardly from the punch block PB in all three views remains constant, whereas the amount extended tool 46 projects downwardly relative to the punch block increases as the ram progresses downwardly from its upper FIG. 9 position to its lower FIG. 11 position.

In operation, the finite amount of additional vertical downward movement of the plunger block 20 and the plunger rods 40 carried by it, is determined by the ratio of the distances from the plunger block to the fulcrum pin and the fulcrum pin to the fixed lever end, which ratio is a fractional multiplier of the ram stroke to ascertain the additional movement of the plunger block. For example, in my assignee's Model 4-37 MTP Press, having a maximum ram stroke of 5 inches, if my invention is incorporated with a fulcrum point, i.e., the center of the lever fulcrum pin, 4 inches in front of the line of the plunger block and the fixed lever end 20 inches from the fulcrum point, the plunger block moves one fifth of the ram stroke in addition to the ram stroke, for a total plunger block stroke of 6 inches. It should be understood that these ratios are variable, within limits, but in practice it has been found that the addition of one quarter of the ram stroke is desirable. It should also be understood that the plunger block moves with the same cam characteristics as the ram and differs only in that it has a longer stroke. Further the timing of the movement of the plunger block and extended tools which it carries is precisely the same as that of the punch block and fixed tools it carries because the plunger block motion is only a multiplication of the ram motion.

When incorporating my punch extending mechanism in an existing transfer press, some minor modification of the press is necessary. For example, the underside of the die bed at the stations where the extended motion punch tools are mounted may require downwardly extending collars, such as those shown in FIG. 13 and designated EC4 and EC5. This is required due to the exceptional length of the parts P4 and P5 drawn by the extended tools ET4 and ET5 at stations 4 and 5, in the illustration. The knockout plunger rods KP4 and KP5 should not be allowed to slip out of their guide blocks at the bottom of the die bed due to the extended length of punch tools ET4 and ET5. To prevent this an extension block may be fitted and attached to the die bed beneath stations 4 and 5 to keep the knockout plungers in their guides in alignment with the openings in the dies. Also, the stroke of the standard knockout cam and lever may be insufficient to allow for the exceptional length of the cupped part. In order to make this arrangement functional, a special long-stroke lever assembly must be provided, including a knockout bracket, cam, lever and cam roll, which will provide a sufficient amount of upwardly vertical knockout movement at all stations where the extended movement tools are mounted or, thereafter, where the long drawn part must fully enter a die.

It will be understood by those skilled in the art that the general operation of a transfer press incorporating my invention is conventional and the same as is understood in the art, with the principal exception that at two of the work stations, extended movement punch tools are provided to permit the effecting of a longer draw on a part than that which otherwise would be permitted for conventional fixed tools by any given size and configured machine. My double punch extender mechanism enhances the drawing capability by more than twice that which would be effected if only a single extended movement punch tool were employed. This obtains, other factors such as metallurgy of the part permitting and being equal, because at any single drawing station approximately 15 percent of the diameter of the part may be reduced and the material made available by this diameter reduction may be put into extended length of the part. Therefore, the amount of material provided to be put into additional length is greater after the first extended punch drawing operation than that available prior thereto. Hence, the extended motion at the second extended punch drawing operation is greater than that at the first. Therefore, with my double punch extender mechanism, the additional amount of drawing exceeds twice the additional amount provided by a single extended punch. Further, with my double extended punch mechanism, either or both of the plungers at the two extended tool stations may be loaded with extended punch tools, which gives flexibility to operation.

A specific instance of enhanced operation and increased drawing capability of transfer presses equipped with my invention may be appreciated by considering the situation where an aluminum part to be manufactured dimensionally requires the maximum stroke of an existing Model 4-37 MTP press, but the tonnage of the smaller Model 3-25 MTP. By incorporating my punch extender mechanism into the Model 3-25 MTP press, it could make this part and thereby avoid having to purchase the larger, more expensive Model 4-37 MTP press as was previously required.

In view of the foregoing, it should be apparent that I have achieved the objects of this invention. As will be apparent to those skilled in the art, various changes and modifications of the invention can be made without departing from the spirit and scope of the invention, which is limited only by the following claims.

I claim:

1. A multi-station metal forming press comprising: a single reciprocating ram; a plurality of tools carried by said ram is fixed positions relative thereto and individually being disposed at the stations, said tools being mounted for simultaneous movement with said ram jointly the same linear distance, whereby the maximum amount of linear movement of said ram and said tools is limited by the inherent configuration of said press thereby limiting the length of work piece drawing capacity of said tools; a transfer means for carrying a work piece sequentially in a predetermined manner to each station; an additional pair of tools at two of the stations; and means mounting said additional pair of tools on said ram for simultaneous movement therewith but a linear distance greater than the linear distance said ram moves, whereby said additional pair of tools have a work piece drawing capacity greater than that of said tools.

2. A press as defined in claim 1 wherein said pair of tools are disposed at two central stations.

3. A press as defined in claim 1 wherein said ram is mounted for vertical reciprocation.

4. A press as defined in claim 3 wherein the press is configured to physically accommodate a removable die set of predetermined dimensions comprising a die block and an operationally associated punch block; said die block being rigidly fixed to the bed of the press and arranged to support a plurality of dies; said punch block being rigidly fixed to and movable with said ram and arranged to support said fixed tools, whereby the configuration of said die set determines the maximum vertical linear movement of said punch block and the fixed tools it supports.

5. A press as defined in claim 3 wherein said means for mounting said additional pair of tools comprises a plunger block mounted on said ram for vertical movement relative thereto which rigidly carries a pair of vertically extending plunger rods that are arranged to support said pair of tools in operative position at two work stations; means mounting said plunger block to move vertically simultaneously with said ram, but a greater vertical linear distance, whereby said plunger rods and the tools carried by them move vertically a greater linear distance than said ram and said fixed tools carried by said ram.

6. A press as defined in claim 5 wherein said plunger block mounting means comprise a vertical slideway on said ram in which said plunger block is mounted; a pivotally mounted lever mounted near one of its ends on a fulcrum pin supported by said ram, said lever at its said one end being in driving engagement with said plunger block, and its other end pivotally mounted for limited pivotal movement of said other end and its pivot point, the dispositional relationship of said lever, ram and fulcrum pin being such that vertical movement of said ram causes said plunger block to move simultaneously with it, but a greater vertical linear distance than said ram as a result of the magnified vertical movement of said plunger block relative to said ram caused by the controlled pivotal movement of said lever during movement of said ram which causes said one end of said lever to drive said plunger block vertically relative to said ram, which latter vertical movement is in addition to the amount of vertical movement of said plunger block caused by movement of said ram otherwise.

7. A press as defined in claim 6 wherein said other end of said lever is pivotally connected to an end of a link in a manner so as to preclude any significant vertical movement of the pivot point of the pivotal connection, whereby on vertical movement of said ram, said lever pivots on said fulcrum pin and said one end of said lever moves vertically relative to said ram thereby moving said plunger block vertically in said slideway relative to said ram to cause said punch block to move vertically a greater distance than said ram.

8. A press as defined in claim 6 wherein the driving connection between said one lever end and said plunger block comprises a hardened involute shaped tooth rigidly carried by said lever at said one end of said lever which operationally engages cooperating driving surfaces formed in said plunger block.

9. A press as defined in claim 8 wherein the driving connection comprises a pair of spaced involute teeth formed on a pair of plates that are rigidly secured to said one end of said lever, and said plunger block includes cooperating driving surfaces for each of said teeth.

10. A press as defined in claim 6 wherein said slideway is formed by a portion of a vertical face of said ram and a pair of spaced bearing blocks that are rigidly secured to said ram on said face to form with said portion thereof a three-sided slideway for and in which said plunger block is disposed for controlled vertical movement in said slideway.

11. A press as defined in claim 10 wherein said bearing blocks rigidly support said fulcrum pin and a portion of said lever extends between them.

12. A multi-station metal forming press comprising a press frame; a ram supported by said frame for vertical reciprocation; means forming a plurality of work stations arranged to support dies; a transfer means for carrying a work piece sequentially in a predetermined manner to each station; said ram supporting a plurality of punch-like tools disposed relative thereto in fixed position and operatively associated with said dies; said tools being mounted for simultaneous movement with said ram jointly the same linear distance, whereby the maximum amount of vertical linear movement of said ram and said tools is limited by the inherent configuration of said press thereby limiting the maximum length of work piece drawing capacity of said tools; a pair of spaced bearing blocks rigidly secured to the face of said ram and forming therewith a three-sided vertical slideway; a plunger block mounted in said slideway for controlled vertical movement; an additional pair of tools disposed operatively at two of the stations and supported for vertical movement by said plunger block; said plunger block mounted so as to move simultaneously with said ram, but a greater vertical linear distance as a result of an additional increment of vertical movement in addition to that otherwise caused by movement of said ram; said additional increment of movement being caused by a pivotally mounted lever which is provided on a fulcrum pin supported by said bearing blocks and has an inner end in driving engagement with said plunger block and an outer end pivotally mounted for limited movement of its pivot point, the dispositional relationship of said lever, said ram and said fulcrum pin being such that vertical movement of said ram causes said plunger block to move simultaneously with said ram, but a greater vertical linear distance as a result of the vertical movement of said plunger block in said slideway caused by the controlled pivotal movement of said lever during movement of said ram which causes said inner end of said lever to drive said plunger block vertically relative to said ram.

13. A press as defined in claim 12 wherein said other end of said lever is pivotally connected to an end of a link in a manner so as to preclude any significant vertical movement of the pivot point of the pivotal connection, whereby on vertical movement of said ram, said lever pivots on said fulcrum pin and said inner end of said lever moves vertically relative to said ram thereby moving said plunger block vertically in said slideway relative to said ram to cause said punch block to move vertically a greater distance than said ram.

14. A press as defined in claim 12 wherein the driving connection between said inner end and said plunger block comprises a hardened involute shaped tooth rigidly carried by said lever at said inner end which operationally engages cooperating driving surfaces formed in said plunger block.

15. A press as defined in claim 12 wherein said driving connection between said inner end and said plunger block comprises a pair of spaced involute teeth formed on a pair of plates that are rigidly secured to said inner end of said lever, and said plunger block includes cooperating driving surfaces for each of said teeth.

16. A press as defined in claim 12 wherein said press is configured to physically accommodate a removable die set of predetermined dimensions comprising a die block and an operationally associated punch block; said die block is rigidly secured to the bed of the press and supports said dies; said punch block is rigidly secured to and jointly movable with said ram, and arranged to support said punch-like tools, whereby the configuration of said die set determines the maximum vertical linear movement of said punch block and the punch-like tools it supports; and said additional pair of tools are free of support by said punch block.

17. A press as defined in claim 16 wherein the driving connection between said inner end and said plunger block comprises a hardened involute shaped tooth rigidly carried by said inner end which operationally engages cooperating driving surfaces formed in said plunger block.

18. A press as defined in claim 17 wherein said plunger block comprises a pinch bind block and clamp assembly which supports said additional pair of tools.

19. A press as defined in claim 18 wherein said assembly directly supports a pair of punch bars, that, in turn, support said additional pair of tools.

* * * * *

UNITED STATES PATENT AND TRADEMARK OFFICE

CERTIFICATE OF CORRECTION

PATENT NO. : 4,166,372

DATED : September 4, 1979

INVENTOR(S) : David W. Knight

It is certified that error appears in the above-identified patent and that said Letters Patent are hereby corrected as shown below:

Abstract, line 10, insert --a-- between "carrying" and "work".

Column 3, line 7, insert a single asterisk --*-- before the first occurrence of "Max Blank", and insert a double asterisk --**-- before the second occurrence of "Max Blank".

Column 4, line 7, insert a single asterisk --*-- before the first occurrence of "Max Blank", and insert a double asterisk --**-- before the second occurrence of "Max Blank".

Column 4, line 15, "3 1/4" should be --3 3/4--.

Column 3, line 17, "1 1/2" should be --1 5/8--.

Column 4, line 17, "2 1/4" should be --2 3/4--.

Column 4, line 17, "3 1/8" should be --3 3/8--.

Column 4, line 18, "3 1/8" should be --3 3/8--.

Column 3, line 20, "1/4" should be --3/4--.

Column 3, line 24, insert another asterisk --*-- to show a double asterisk --**-- at the beginning of the line.

UNITED STATES PATENT AND TRADEMARK OFFICE

CERTIFICATE OF CORRECTION

PATENT NO. : 4,166,372

DATED : September 4, 1979

INVENTOR(S) : David W. Knight

It is certified that error appears in the above-identified patent and that said Letters Patent are hereby corrected as shown below:

Column 8, line 23, "latter" should be --letter--.

Column 8, line 43, "DK" should be --DH--.

Column 9, line 28 "4" should be --R--.

Column 9, line 52, insert --bind-- between "pinch" and "block".

Column 11, line 36, "TE4" should be --TF4--.

Column 12, line 62, "arm" should be --ram--.

Column 13, line 59, "sleeve" should be --sleeves--.

Column 15, line 55 (claim 1, line 3), "is" should be --in--.

Column 17, line 39 (claim 12, line 27), "provided" should be --pivoted--.

Column 18, line 47 (claim 19, line 2), delete the first comma --,--.

Signed and Sealed this

*Twenty-fifth* Day of *December 1979*

[SEAL]

*Attest:*

SIDNEY A. DIAMOND

*Attesting Officer*

*Commissioner of Patents and Trademarks*